US012565744B2

(12) United States Patent
Zhao et al.

(10) Patent No.: US 12,565,744 B2
(45) Date of Patent: Mar. 3, 2026

(54) SPATIAL MULTI-POINT SYNCHRONOUS CLOSURE CONSTRUCTION METHOD FOR A THREE-MAIN-TRUSS STEEL TRUSS ARCH BRIDGE

(71) Applicant: CHINA RAILWAY CONSTRUCTION BRIDGE ENGINEERING BUREAU GROUP CO., LTD., Tianjin (CN)

(72) Inventors: Jian Zhao, Tianjin (CN); Guannan Zhou, Tianjin (CN); Lilong Fan, Tianjin (CN); Luming An, Tianjin (CN); Yanlong Ren, Tianjin (CN); Weidong Cai, Tianjin (CN); Baoliang Wang, Tianjin (CN); Changhui Liu, Tianjin (CN)

(73) Assignee: China Railway Construction Bridge Engineering Bureau Group Co., Ltd., Tianjin (CN)

( * ) Notice: Subject to any disclaimer, the term of this patent is extended or adjusted under 35 U.S.C. 154(b) by 946 days.

(21) Appl. No.: 17/830,274

(22) Filed: Jun. 1, 2022

(65) Prior Publication Data

US 2022/0290386 A1 Sep. 15, 2022

(51) Int. Cl.

| | |
|---|---|
| ***E01D 21/00*** | (2006.01) |
| ***E01D 4/00*** | (2006.01) |
| ***E01D 19/00*** | (2006.01) |

(52) U.S. Cl.

CPC ..... *E01D 21/00* (2013.01); *E01D 4/00* (2013.01); *E01D 19/00* (2013.01)

(58) Field of Classification Search

CPC .. E01D 4/00; E01D 6/02; E01D 19/00; E01D 21/00

USPC ..... 14/25, 77.1

See application file for complete search history.

(56) References Cited

FOREIGN PATENT DOCUMENTS

| | | | | |
|---|---|---|---|---|
| CN | 112458917 A | * | 3/2021 | ..... E01D 21/00 |
| CN | 116837728 A | * | 10/2023 | ..... E01D 21/00 |
| CN | 117119402 A | * | 11/2023 | ..... E01D 21/105 |
| CN | 220538410 U | * | 2/2024 | |
| CN | 118110099 A | * | 5/2024 | ..... E01D 19/04 |
| CN | 118422581 B | * | 11/2024 | ..... E01D 4/00 |

* cited by examiner

*Primary Examiner* — Gary S Hartmann

(57) ABSTRACT

A spatial multi-point synchronous closure construction method for a three-main-truss steel truss arch bridge. The method includes mounting standard rods, adjusting the standard rods to designed coordinates, observing coordinates and spacing of closure rods, processing and mounting the closure rods, adjusting spatial locations, monitoring the atmospheric temperature, analyzing a change rule, pushing the standard rods, adjusting gaps, and carrying out closure.

10 Claims, 4 Drawing Sheets

SPATIAL MULTI-POINT SYNCHRONOUS CLOSURE CONSTRUCTION METHOD FOR A THREE-MAIN-TRUSS STEEL TRUSS ARCH BRIDGE

TECHNICAL FIELD

The present invention belongs to the technical field of bridges, and in particular relates to a spatial multi-point synchronous closure construction method for a three-main-truss steel truss arch bridge.

BACKGROUND

During the construction of a middle-span closure of a long-span three-main-truss steel truss arch bridge, problems such as low closure construction efficiency, poor closure accuracy, and difficulty in adjusting the closure gap often occur. The main reason is that the structural rods of the three-main-truss steel truss arch bridge are high in stiffness, heavy, and difficult to adjust, and the closure opening is not precisely aligned. Engineering examples show that the three-main-truss steel truss arch bridge has a maximum of 12 closure opening nodes. The traditional closure method is difficult to control closure gaps by adjusting the temperature change, cannot achieve spatial multi-point synchronous closure, and has low efficiency and poor accuracy, which can no longer meet the needs of rapid construction of spatial alignment of the closure opening of the three-main-truss steel truss arch bridge, and thus the construction period and construction quality are greatly affected.

Therefore, the inventor is committed to designing a construction method to solve the above-mentioned problems.

SUMMARY

The purpose of the present invention is to provide a spatial multi-point synchronous closure construction method for a three-main-truss steel truss arch bridge. The resulting three-main-truss steel truss arch bridge is simple in structure and easily mounted and disassembled. The control difficulty, low efficiency, poor accuracy and other problems in the closure of the three-main-truss steel truss arch bridge, can be improved, and the construction quality of closure is improved.

In order to achieve the above-mentioned object, a technical solution adopted in the present invention is:

A spatial multi-point synchronous closure construction method for a three-main-truss steel truss arch bridge, comprising the following steps:

S1, setting up standard rods on side piers on both sides to form a closure opening between the standard rods on both sides, and adjusting free ends of the two standard rods at the closure opening to the designed spatial coordinate locations;

S2, relatively re-measuring the spatial coordinates of the two standard rods at the closure opening and a closure opening spacing to obtain the closure opening spacing, and accurately positioning same;

S3, processing closure rods, and mounting fine adjustment devices on the free ends of the two standard rods at the closure opening;

S4, mounting the closure rods on one of the standard rods at the closure opening, and adjusting the spatial positions of the closure rods;

S5, monitoring the atmospheric temperature and analyzing the changing rule of the closure opening;

S6, pushing the other standard rod at the closure opening along a closure direction to form closure gaps;

S7, finely adjusting the closure gaps along the closure direction of the bridge by using the fine adjustment devices; and

S8, fixing and closuring the closure rods with the corresponding standard rods.

As an improvement of the spatial multi-point synchronous closure construction method for a three-main-truss steel truss arch bridge of the present invention, the step S1 further comprises: setting up standard rods on side piers on both sides by using a girder crane so that a closure opening is formed between the standard rods on the both sides, adjusting vertical coordinate positions of the free ends of the two standard rods at the closure opening by using the lever principle for a top drop girder at a side span auxiliary pier, and adjusting lateral coordinate positions of the free ends of the two standard rods at the closure opening by using an inverted chain.

As an improvement of the spatial multi-point synchronous closure construction method for a three-main-truss steel truss arch bridge of the present invention, the step S2 further comprises: providing measurement control points by using a total station, performing spatial multi-point relative re-measurement by means of the relative control points, determining relative coordinates of the two standard rods at the closure opening, and measuring a closure opening spacing and accurately positioning same.

As an improvement of the spatial multi-point synchronous closure construction method for a three-main-truss steel truss arch bridge of the present invention, the step S3 further comprises: processing closure rods according to the relative re-measurement result, and mounting fine-turning devices on the free ends of the two standard rods at the closure opening.

As an improvement of the spatial multi-point synchronous closure construction method for a three-main-truss steel truss arch bridge of the present invention, the step S4 further comprises: mounting the closure rods one by one by using a girder crane on one of the standard rods at the closure opening, with the vertical mounting sequence of the closure rods of: a lower chord, an inclined chord and an upper chord, and the plane mounting sequence of the closure rods of: a middle truss chord, a side truss chord and a parallel inclined chord, and adjusting the spatial positions of the closure rods.

As an improvement of the spatial multi-point synchronous closure construction method for a three-main-truss steel truss arch bridge of the present invention, the step S5 further comprises: monitoring the temperature of the closure opening for 6-7 days by using a thermometer, and analyzing the change rule of the gaps at the closure opening.

As an improvement of the spatial multi-point synchronous closure construction method for a three-main-truss steel truss arch bridge of the present invention, the step S6 further comprises: when the atmospheric temperature is stable, pushing the other standard rod at the closure opening along the closure direction by using a pushing device to form closure gaps.

As an improvement of the spatial multi-point synchronous closure construction method for a three-main-truss steel truss arch bridge of the present invention, the step S7 further comprises: finely adjusting the closure gaps by using the fine adjustment devices along the closure direction of the bridge when the closure gaps reach 4 mm-6 mm.

As an improvement of the spatial multi-point synchronous closure construction method for a three-main-truss steel truss arch bridge of the present invention, the fine adjustment devices comprise a pulling jack, a jacking jack, a steel strand and two jacking anchor boxes, wherein the two jacking anchor boxes are arranged on the free ends of two standard rods at the closure opening, the jacking jack is located between the two jacking anchor boxes, the pulling jack is far away from the two jacking anchor boxes, and the steel strand passes through the jacking anchor boxes, the pulling jack and the jacking jack.

As an improvement of the c spatial multi-point synchronous closure construction method for a three-main-truss steel truss arch bridge of the present invention, the step S8 further comprises: mounting positioning bolts in positioning holes, then driving 30% punching nails and 50% high bolts, and replacing the punching nails with high bolts and screwing same in place, so that the closure rods and the corresponding standard rods are fixed and closured.

Compared with the prior art, according to the spatial multi-point synchronous closure construction method for a three-main-truss steel truss arch bridge of the present invention, the closure is completed by the following steps: mounting standard rods, adjusting free ends of the standard rods at a closure opening to the designed spatial coordinate locations, observing spatial coordinates of closure rods and a closure opening spacing, processing the closure rods, mounting the closure rods, adjusting spatial locations of the closure rods, monitoring the atmospheric temperature, and analyzing the change rule of the closure opening; and when the temperature is stable, pushing the standard rods, achieving the closure of fixed ends, and adjusting closure gaps. The resulting three-main-truss steel truss arch bridge is simple in structure and easily mounted and disassembled. According to the spatial multi-point synchronous closure construction method for a large-span three-main-truss steel truss arch bridge, problems such as difficult control, low efficiency and poor precision of a three-main-truss steel truss arch bridge can be improved, and the construction quality of closure is improved.

DESCRIPTION OF REFERENCE NUMBERS

1. Arch rib upper chord; 2. Arch rib inclined rod; 3. Arch rib lower chord; 4. Arch rib standard rod; 5. Main girder upper chord; 6. Main girder inclined rod; 7. Main girder lower chord; 8. Main girder standard rod; 9. closure gap; 10. Positioning hole; 11. Jacking anchor box; 12. Pulling jack; 13. Jacking jack; 14. Steel strand; 15. Pushing device; 151. Pushing corbel; 152. Steel backing plate; 153. Digital hydraulic jack; 154. Laser distance meter; 155. Bearing; 156. Support cushion; 157. Moveable support; and 158. Steel truss girder support.

DETAILED DESCRIPTION

The embodiments of the present invention will be explained in detail below with reference to the accompanying drawings. The accompanying drawings are only used for reference and description, and do not limit the scope of the patent protection of the present invention.

Figure 4:
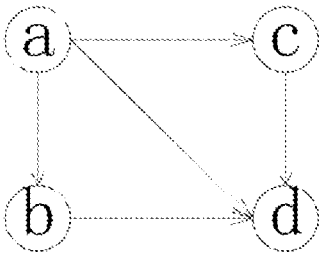
FIG. 4 is a schematic diagram of elevation re-measurement before the closure in the spatial multi-point relative re-measurement method of the present invention.
Figure 5:
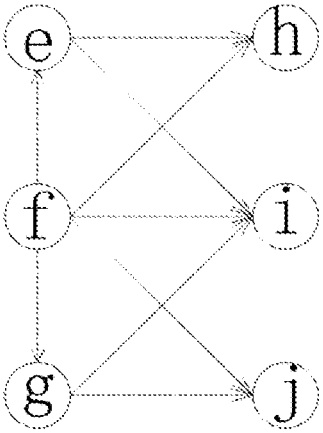
FIG. 5 is a schematic diagram of plane re-measurement before the closure in the spatial multi-point relative re-measurement method of the present invention.
Figure 6:
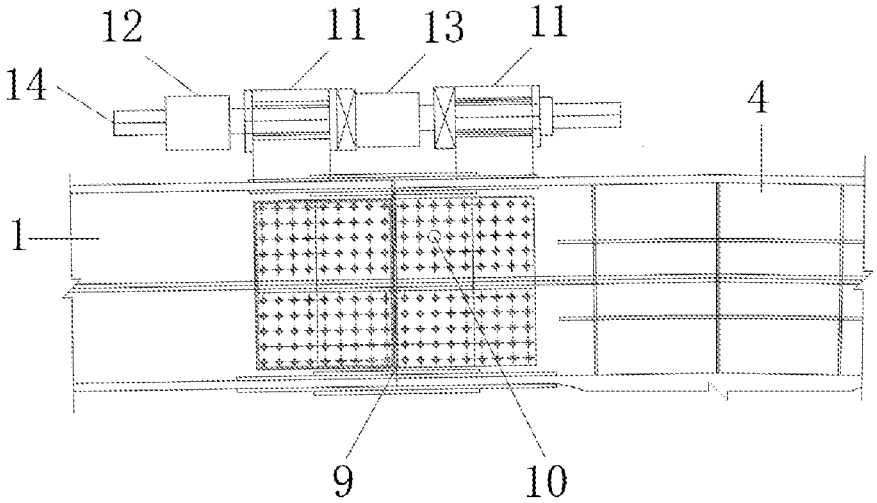
FIG. 6 is a schematic structural diagram of the pushing device of the present invention.

Referring to FIGS. 1 to 9, a spatial multi-point synchronous closure construction method for a three-main-truss steel truss arch bridge, comprising the following steps:

Step S1: setting up standard rods on side piers on both sides by using a girder crane so that a closure opening is formed between the standard rods on both sides, adjusting vertical coordinate positions of the free ends of the two standard rods at the closure opening by using the lever principle for a top drop girder at a side span auxiliary pier, and adjusting lateral coordinate positions of the free ends of the two standard rods at the closure opening by using an inverted chain;

Step S2: providing measurement control points on the tops of the upper and lower chords by using a total station, at the elevation: a, b, c, d (as shown in FIG. 4), and at the plane: e, f, g, h, i, j (as shown in FIG. 5), performing spatial multi-point relative re-measurement by means of the relative control points, determining relative coordinates of the two standard rods at the closure opening, and measuring a closure opening spacing and accurately positioning same;

Step S3: processing closure rods according to the relative re-measurement result, and mounting fine adjustment devices on the free ends of the two standard rods at the closure opening;

Step S4: mounting the closure rods one by one by using a girder crane on one of the standard rods at the closure opening, with the vertical mounting sequence of the closure rods of: a lower chord, an inclined chord and an upper chord, and the plane mounting sequence of the closure rods of: a middle truss chord, a side truss chord and a parallel inclined chord, and adjusting the spatial positions of the closure rods;

Step S5: monitoring the temperature of the closure opening for 6-7 days by using a thermometer, and analyzing the change rule of the gaps of the closure opening;

Step S6: when the atmospheric temperature is stable, pushing the other standard rod at the closure opening along the closure direction by using a pushing device 15 to form a closure gap 9;

Step S7: finely adjusting the closure gap 9 by using the fine adjustment devices along the closure direction of the bridge when the closure gap 9 reaches 4 mm-6 mm; and Step S8: driving a positioning bolt through a positioning hole 10 with a preset diameter of 50 mm, then driving 30% punching nails and 50% high bolts, and replacing the punching nails with high bolts and screwing same in place, so that the closure rods and the corresponding standard rods are fixed and closured.

In the step S3, the fine adjustment devices comprise a pulling jack 12, a jacking jack 13, a steel strand 14 and two jacking anchor boxes 11, wherein the two jacking anchor boxes 11 are arranged on the free ends of two standard rods at the closure opening, the jacking jack 13 is located between the two jacking anchor boxes 11, the pulling jack 12 is far away from the two jacking anchor boxes 11, and the steel strand 14 passes through the jacking anchor boxes 11, the pulling jack 12 and the jacking jack 13. Fine measurement can be achieved by making the steel strand 14 pass through the jacking anchor boxes 11, the pulling jack 12 and the jacking jack 13.

Figure 7:
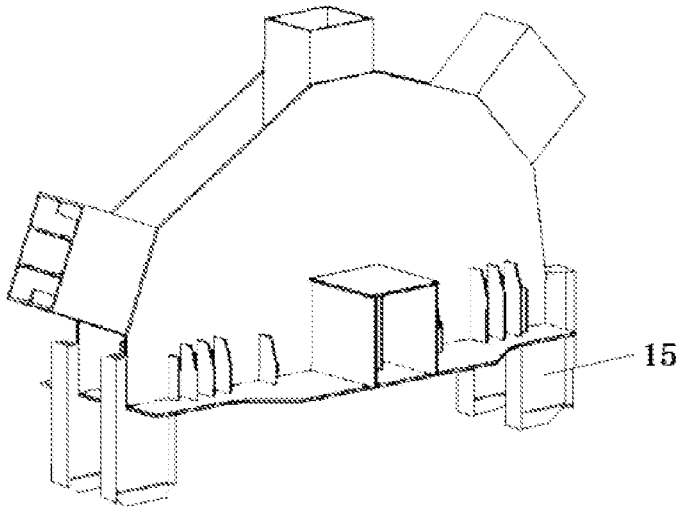
FIG. 7 is a three-dimensional schematic structural diagram of the arrangement of pushing corbels and steel truss girder supports of the present invention.
Figure 8:
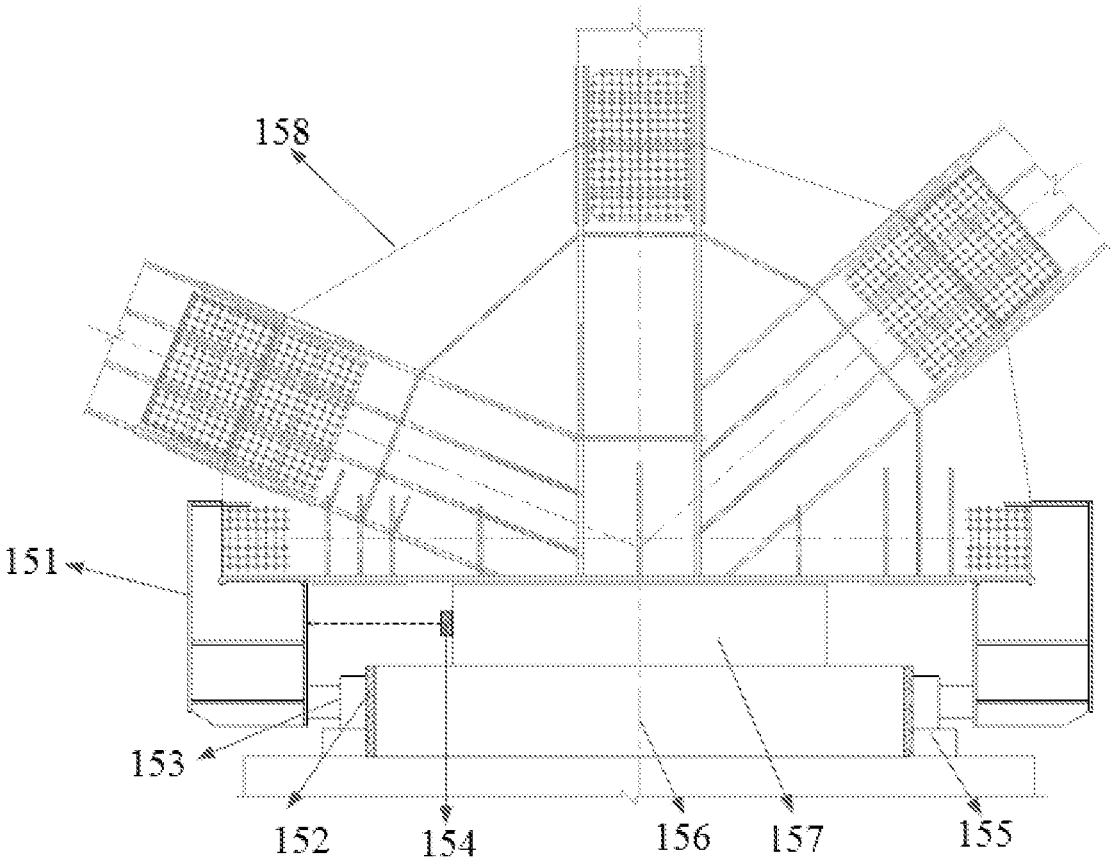
FIG. 8 is a schematic diagram of elevation arrangement of the pushing device of the present invention in a pushing state.
Figure 9:
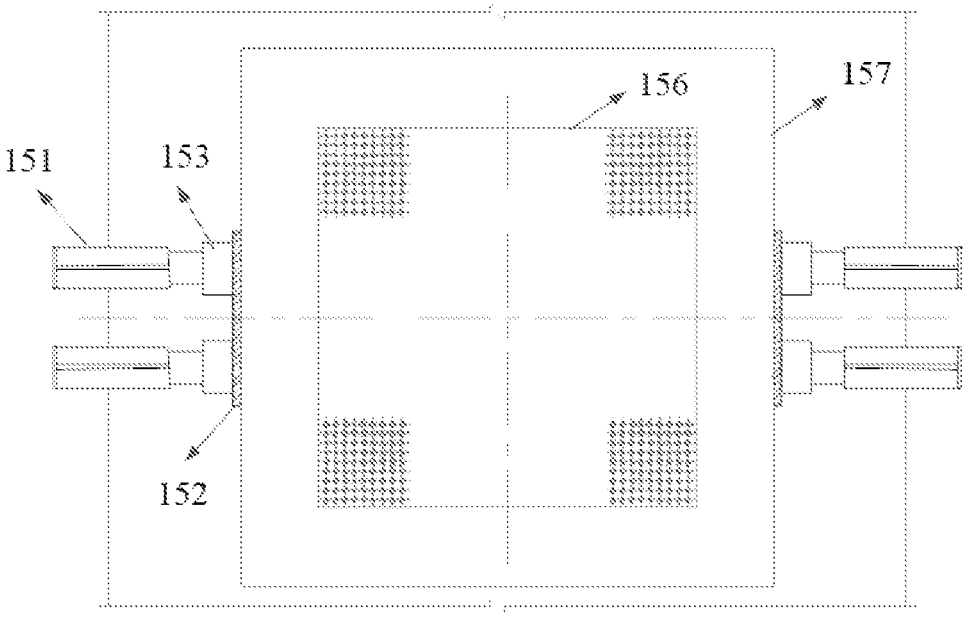
FIG. 9 is a schematic diagram of plane arrangement of the pushing device of the present invention in a pushing state.

Referring to FIGS. 7 to 9, in the step S6, the pushing device 15 comprises a steel truss girder support 158, several pushing corbels 151, a movable support 157, and a support cushion 156 provided at the bottom of the movable support 157, where several jacking corbels 151 are fixedly connected to both sides of the bottom of the steel truss girder support 158, respectively, and the movable support 157 and the support cushion 156 are located between pushing corbels 151 on the both sides of the bottom of the steel truss girder support 158, where the position between the two sides of the support cushion 156 and the pushing corbel 151 is provided with a longitudinal-moving pushing device, which comprises a laser distance meter 154 and a digital hydraulic jack 153, where the digital hydraulic jack 153 is mounted on the pushing corbels 151, and the movable end of the digital hydraulic jack 153 is close to the support cushion 156; and the laser distance meter 154 is mounted on the side of the movable support 157 and faces toward the pushing corbels 151. In the process of mid-span closure of a steel truss girder, in order to realize the adjustment of longitudinal offset of a closure opening, a stainless steel plate, an MGE plate and a pad steel plate are withdrawn, the digital hydraulic jack 153 pushes the steel girder to move longitudinally according to the measured longitudinal deviation value of the closure opening, and the longitudinal movement is measured by the laser distance meter 154. Moreover, in the present application, the selection of a model of the digital hydraulic jack 153 needs to be determined according to the characteristic parameters of the movable support 157 at the pushing position, the self-weight of the upper steel girder, and the friction coefficients of the rest support positions of the buttresses.

Furthermore, a steel backing plate 152 is further provided on the side of the support cushion 156, and the movable end of the digital hydraulic jack 153 is closely attached to the steel backing plate 152. The entire longitudinal-moving pushing device makes full use of the main body structure, and provides the steel backing plate 152 on the contact surface of the support cushion 156 as a reaction force seat for the pushing of the digital hydraulic jack 153, thus balancing the force on the cushion e and preventing from damage caused by local compression on concrete of the cushion.

Furthermore, the longitudinal-moving pushing device further comprises a bearing 155, which is closely attached to the steel backing plate 152, and supports the movable end of the digital hydraulic jack 153.

At the same time, according to the layout form of the structure, for a three-main-truss bridge, six digital hydraulic jacks 153 need to be arranged laterally. The digital hydraulic jacks 153 and the laser distance meter 154 can convert the jacking force and distance information of the digital hydraulic jacks 153 into digital information and transmit same to a data processor. The data processor can display monitoring information in real time, and transmit a command signal to the digital hydraulic jacks 153 according to the information processing. The jacking force of each jack is controlled, so that multiple jacks can work together to prevent the girder body from deflecting due to unbalanced jacking force, thus finally realizing the active control of the longitudinal adjustment of the steel girder.

Figure 1:
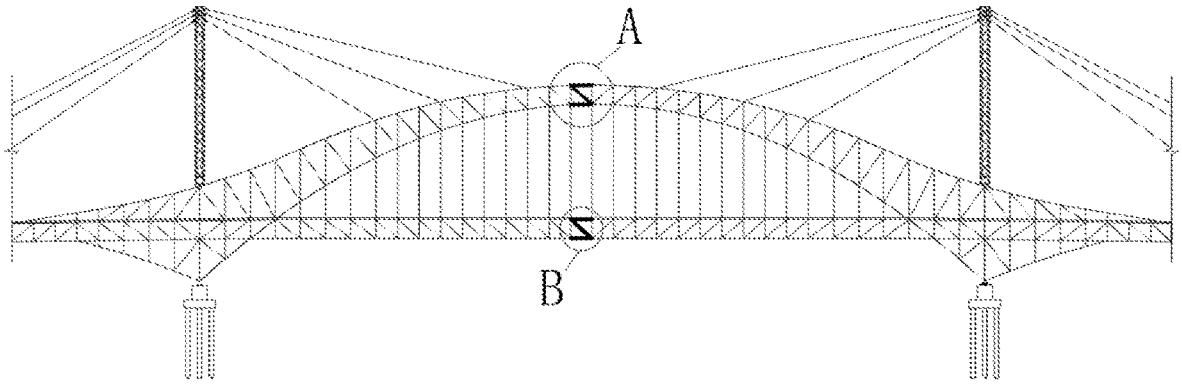
FIG. 1 is a general structural diagram of the three-main-truss steel truss arch bridge of the present invention.
Figure 2:
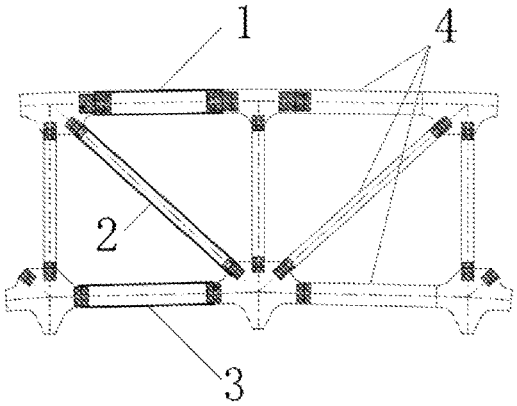
FIG. 2 is a structural diagram of arch rib closure rods and arch rib standard rods at A in FIG. 1.
Figure 3:
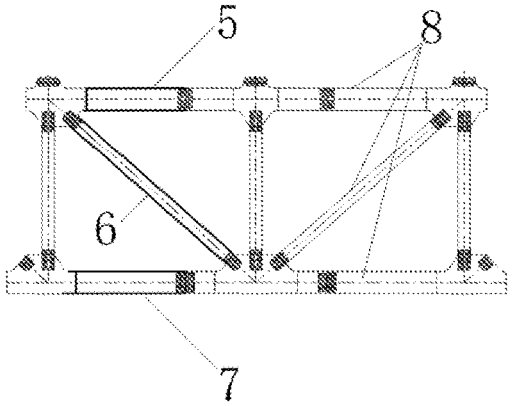
FIG. 3 is a structural diagram of main girder closure rods and main girder standard rods at B in FIG. 1.

Referring to FIG. 1, FIG. 2 and FIG. 3, since the bridge constructed by the present invention has both main girders and arch ribs, it is necessary to closure the main girders and the arch ribs respectively, or to closure the two synchronously, so that the standard rods are main girder standard rods 8 and/or arch rib standard rods 4, the closure rods are main girder upper chords and/or arch rib closure rods, the main girder closure rods comprise a main girder upper chord 5, a main girder inclined rod 6, a main girder lower chord 7, a main girder middle truss chord, a main girder side truss chord and a main girder parallel inclined rod (as shown in FIG. 3), and the arch rib closure rods comprise an arch rib upper chord 1, an arch rib inclined rod 2, an arch rib lower chord 3, an arch rib middle truss chord, an arch rib side truss chord and an arch rib parallel inclined rod (as shown in FIG. 2).

When the main girders are closured, the standard rods are the main girder standard rods 8, and the closure rods are the main girder closure rods. The step S2 comprises: providing measurement control points on the tops of the main girder upper chord 5 and the main girder lower chord 7 by using a total station, at the elevation: a, b, c, d (as shown in FIG. 4), and at the plane: e, f, g, h, i, j (as shown in FIG. 5), performing spatial multi-point relative re-measurement by means of the relative control points, determining relative coordinates of the two standard rods at the closure opening, and measuring a closure opening spacing and accurately positioning same; and the step S4 comprises: mounting the closure rods one by one by using a girder crane on one of the standard rods 8 at the closure opening, with the vertical mounting sequence of the main girder closure rods of: the main girder lower chord 7, the main girder inclined rod 6 and the main girder upper chord 5, and the plane mounting sequence of the main girder closure rods of: the main girder middle truss chord, the main girder side truss chord and the main girder parallel inclined chord, and adjusting the spatial positions of the main girder closure rods according to preset coordinates.

When the arch ribs are closured, the standard rods are the arch rib standard rods 4, and the closure rods are the arch rib closure rods. The step S2 comprises: providing measurement control points on the tops of the arch rib upper chord 1 and the arch rib lower chord 3 by using a total station, at the elevation: a, b, c, d (as shown in FIG. 4), and at the plane: e, f, g, h, i, j (as shown in FIG. 5), performing spatial multi-point relative re-measurement by means of the relative control points, determining relative coordinates of the two arch rib standard rods at the closure opening, and measuring a closure opening spacing and accurately positioning same; and the step S4 comprises: mounting the arch rib closure rods one by one by using a girder crane on one of the arch rib standard rods 4 at the closure opening, with the vertical mounting sequence of the arch rib closure rods of: the arch rib lower chord 3, the arch rib inclined rod 2 and the arch rib upper chord 1, and the plane mounting sequence of the arch rib closure rods of: the arch rib middle truss chord, the arch rib side truss chord and the arch rib parallel inclined chord, and adjusting the spatial positions of the arch rib closure rods according to preset coordinates.

Compared with the traditional construction method, the construction method of the present invention has the following technical effects:

(1) an auxiliary pier top and falling girder construction method is used to adjust the vertical height difference of the closure opening, which, compared with the traditional closure opening adjustment method, avoids the adjustment of cable force of a stay cable and reduces the construction difficulty;

(2) a "spatial multi-point relative re-measurement method" is used to control the accuracy of ends of the closure rods, which, compared with the traditional measurement method, effectively improves the measurement accuracy of the closure;

(3) the movable support end is used to actively push the closure, and then the fine adjustment devices are used to finely adjust gaps at the closure opening, which, compared with the traditional closure method, effectively improves the adjustment efficiency of gaps at the closure opening, and can achieve the effect of zero-error closure; and (4) after the comprehensive application of the present invention, the closure precision and the closure construction efficiency can be improved, and the construction period cost can be saved. Therefore, the closure method has many advantages, is especially suitable for popularization and application in this field, has broad market prospect, and can be applied to the arch rib closure construction of a three-main-truss steel truss arch bridge.

The above-mentioned disclosures are only the preferred embodiments of the present invention, which cannot limit the protection scope of the present invention. Therefore, equivalent changes made according to the scope of the patent application of the present invention are still fall within the scope of the present invention.

What is claimed is:

1. A spatial multi-point synchronous closure construction method for a three-main-truss steel truss arch bridge, comprising the following steps:

S1, setting up standard rods on side piers on both sides to form a closure opening between the standard rods on both sides, and adjusting free ends of the two standard rods at the closure opening to designed spatial coordinate locations;

S2, relatively re-measuring spatial coordinates of the two standard rods at the closure opening and a closure opening spacing to obtain the closure opening spacing, and accurately positioning the two standard rods at the closure opening;

S3, processing closure rods, and mounting a fine adjustment device on the free ends of the two standard rods at the closure opening;

S4, mounting the closure rods on one of the standard rods at the closure opening, and adjusting the spatial positions of the closure rods;

S5, monitoring an atmospheric temperature and obtaining a changing rule of the closure opening;

S6, pushing the other one of the standard rods at the closure opening along a closure direction to form a closure gap;

S7, finely adjusting the closure gap along the closure direction of the bridge with the fine adjustment device; and S8, fixing and closuring the closure rods with the two standard rods at the closure opening.

2. The spatial multi-point synchronous closure construction method of claim 1, wherein the step S1 further comprises: setting up standard rods on side piers on both sides with a girder crane such that the closure opening is formed between the standard rods on both sides, adjusting vertical coordinate positions of the free ends of the two standard rods at the closure opening with a lever principle for a top drop girder at a side span auxiliary pier, and adjusting lateral coordinate positions of the free ends of the two standard rods at the closure opening with an inverted chain.

3. The spatial multi-point synchronous closure construction method of claim 1, wherein the step S2 further comprises: providing measurement control points with a total station, performing spatial multi-point relative re-measurement based on the relative control points, determining relative coordinates of the two standard rods at the closure opening, and measuring a closure opening spacing and accurately positioning the two standard rods at the closure opening.

4. The spatial multi-point synchronous closure construction method of claim 1, wherein the step S3 further comprises: processing closure rods according to a relative re-measurement result, and mounting the fine adjustment device on the free ends of the two standard rods at the closure opening.

5. The spatial multi-point synchronous closure construction method of claim 1, wherein the step S4 further comprises: mounting the closure rods one by one with a girder crane on one of the standard rods at the closure opening, with a vertical mounting sequence of the closure rods of: a lower chord, an inclined chord and an upper chord, and a plane mounting sequence of the closure rods of: a middle truss chord, a side truss chord and a parallel inclined chord, and adjusting the spatial positions of the closure rods.

6. The spatial multi-point synchronous closure construction method of claim 1, wherein the step S5 further comprises: monitoring the temperature of the closure opening for 6-7 days with a thermometer, and analyzing the change rule of a gap at the closure opening.

7. The spatial multi-point synchronous closure construction method of claim 1, wherein the step S6 further comprises: when the atmospheric temperature is stable, pushing the other one of the standard rods at the closure opening along the closure direction with a pushing device to form the closure gap.

8. The spatial multi-point synchronous closure construction method of claim 1, wherein the step S7 further comprises: finely adjusting the closure gap by using with the fine adjustment device along the closure direction of the bridge when the closure gap reaches 4 mm-6 mm.

9. The spatial multi-point synchronous closure construction method of claim 1, wherein the fine adjustment device comprise a pulling jack, a jacking jack, a steel strand and two jacking anchor boxes, wherein the two jacking anchor boxes are arranged on the free ends of two standard rods at the closure opening, the jacking jack is located between the two jacking anchor boxes, the pulling jack is far away from the two jacking anchor boxes, and the steel strand passes through the jacking anchor boxes, the pulling jack and the jacking jack.

10. The spatial multi-point synchronous closure construction method of claim 1, wherein the step S8 further comprises: mounting positioning bolts in positioning holes, then driving 30% punching nails and 50% high bolts, and replacing the punching nails with high bolts and screwing the high bolts in place, such that the closure rods and the corresponding standard rods are fixed and closured.

* * * * *